US006193245B1

(12) United States Patent
Vensel

(10) Patent No.: US 6,193,245 B1
(45) Date of Patent: Feb. 27, 2001

(54) SNOWBOARD RELEASABLE AND REATTACHABLE BINDING SYSTEM

(76) Inventor: Douglas Eugene Vensel, 130 Randy Dr., Butler, PA (US) 16002-3859

( * ) Notice: Subject to any disclaimer, the term of this patent is extended or adjusted under 35 U.S.C. 154(b) by 0 days.

(21) Appl. No.: 09/391,504

(22) Filed: Sep. 8, 1999

Related U.S. Application Data

(60) Provisional application No. 60/099,448, filed on Sep. 8, 1998.

(51) Int. Cl.[7] ..... B62B 9/04

(52) U.S. Cl. ..... 280/14.22; 280/607; 280/11.3

(58) Field of Search ..... 280/607, 617, 280/618, 623, 624, 626, 14.2, 634, 627, 613, 14.21, 14.22, 14.23, 11.3, 11.33, 11.34; 403/321, 322.1, 322.3, 322.4, 323, 324, 325

(56) References Cited

U.S. PATENT DOCUMENTS

| | | | | |
|---|---|---|---|---|
| 3,154,312 | * | 10/1964 | Marchand | 280/14.2 |
| 4,037,488 | * | 7/1977 | Laney, Sr. | 74/548 |
| 4,161,324 | * | 7/1979 | Colvin | 280/14.2 |
| 4,492,387 | * | 1/1985 | Spademan | 280/624 |
| 4,652,007 | | 3/1987 | Dennis . | |
| 4,728,116 | | 3/1988 | Hill . | |
| 4,973,073 | | 11/1990 | Raines et al. . | |
| 5,035,443 | | 7/1991 | Kincheloe . | |
| 5,145,202 | * | 9/1992 | Miller | 280/613 |
| 5,190,311 | * | 3/1993 | Carpenter et al. | 280/618 |
| 5,299,823 | * | 4/1994 | Glaser | 280/625 |
| 5,354,088 | | 10/1994 | Vetter et al. . | |
| 5,480,175 | * | 1/1996 | Astier et al. | 280/607 |
| 5,505,478 | | 4/1996 | Napoliello . | |
| 5,660,410 | | 8/1997 | Alden . | |
| 5,669,630 | | 9/1997 | Perkins et al. . | |
| 5,690,351 | | 11/1997 | Karol . | |
| 5,695,210 | | 12/1997 | Goss et al. . | |

(List continued on next page.)

FOREIGN PATENT DOCUMENTS

| | | | | |
|---|---|---|---|---|
| 731026 | * | 3/1966 | (CA) | 280/618 |
| 2363344 | * | 5/1978 | (FR) | 280/613 |

OTHER PUBLICATIONS

Matt Ryan, Hot Air/Snow Skates, Snowboarder Magazine, Jan. 2000, pp. 72, vol. 12 No. 5, Petersen Publishing Co, San Juan Capistrano, CA, USA.

Windell's Snowboard Camp Summer 2000 Brochure PO Box 628 Welches, OR 97067 (800) 765–7669 www. windells.com.

*Primary Examiner*—Brian L. Johnson
*Assistant Examiner*—Gerald Klebe

(57) ABSTRACT

A device is introduced that can be readily adapted to connect any two objects together, including the footwear members of a variety of different recreational or sporting devices in a manner that permits the objects or footwear members to be first attached, release, and then reconnect with each other. The invention is particularly applicable to the sport of snowboarding as it relates to the sport of skateboarding. In a preferred embodiment of the invention, the connecting device is comprised of at least two specially shaped angled bars that are able to slide and lock together. A means to secure the two angled bars together is provided by a connection between a coupling mechanism on one of the bars and a corresponding coupling block on the other angled bar. In addition, there is also a device known as the release enabler that functions to safely monitor the operation of the coupling mechanism. With the release enabler a user can select from either an open or closed position for the connecting device. The open position allows the two angled bars to completely separate and then reattach to each other while the closed position prohibits the two bars from separating (unless they are acted upon by a predetermined amount of force that has been selected by the snowboard rider).

1 Claim, 11 Drawing Sheets

U.S. PATENT DOCUMENTS 5,722,680 * 3/1998 Dodge ..... 280/624
5,755,046 5/1998 Dodge .
5,799,966 * 9/1998 Haldemann ..... 280/613
5,855,390 1/1999 Hassell .
5,871,226 * 2/1999 Klubitschko et al. ..... 280/624
5,915,719 * 6/1999 Bauvois ..... 280/607

* cited by examiner

SNOWBOARD RELEASABLE AND REATTACHABLE BINDING SYSTEM

CROSS-REFERENCE TO RELATED PRIOR ART

| U.S. Patent Documents | | | |
|---|---|---|---|
| 4403785 | Sep., 1983 | Hottel | 280/12H. |
| 4652007 | Mar., 1987 | Dennis | 280/618. |
| 4728116 | Mar., 1988 | Hill | 280/618. |
| 4973073 | Nov., 1990 | Raines et al. | 280/624. |
| 5035443 | Jul., 1991 | Kincheloe | 280/618. |
| 5145202 | Sep., 1992 | Miller | 280/613. |
| 5190311 | Mar., 1993 | Carpenter et al. | 280/618. |
| 5299823 | Apr., 1994 | Glasser | 280/625. |
| 5354088 | Oct., 1994 | Vetter | 280/618. |
| 5505478 | Apr., 1996 | Napoliello | 280/618. |
| 5609347 | Mar., 1997 | Dressel | 280/14.2. |
| 5660410 | Aug., 1997 | Alden | 280/627. |
| 5669630 | Sep., 1997 | Perkins et al. | 280/613. |
| 5690350 | Nov., 1997 | Turner et al. | 280/613. |
| 5690351 | Nov., 1997 | Karol | 280/618. |
| 5695210 | Dec., 1997 | Goss et al. | 280/624. |
| 5755046 | May., 1998 | Dodge | 280/613. |
| 5765854 | Jun., 1998 | Moore et al. | 280/618. |
| 5806876 | Sep., 1998 | Alden | 280/627. |
| 5820155 | Oct., 1998 | Brisco | 280/607. |
| 5826910 | Oct., 1998 | Ricks et al. | 280/618. |
| 5853188 | Dec., 1998 | Alden | 280/627. |
| 5855390 | Jan., 1999 | Hassell | 280/607. |
| 5868416 | Feb., 1999 | Fardie | 280/607. |
| 5901975 | May., 1999 | Phipps | 280/618. |
| 5906058 | May., 1999 | Rench | 36/117.1. |
| 5906388 | May., 1999 | Neiley | 280/613. |
| 5909894 | Jun., 1999 | Meader et al. | 280/623. |
| 5915720 | Jun., 1999 | Turner et al. | 280/613. |
| 5915721 | Jun., 1999 | Laughlin et al. | 280/617 |

| Foreign Patent Documents | | |
|---|---|---|
| 93 06006 | Jan., 1997 | FR. |
| 92 17214U | Oct., 1996 | DE. |
| 20 30429 | Sep., 1992 | CA. |
| 88 05910 | Dec., 1991 | FR. |
| 88 15732 | Oct., 1991 | FR. |

CROSS-REFERENCE TO RELATED APPLICATIONS

Subject matter in this application was originally filed in Provisional patent application Ser. No. 60/099,448, filed on Sep. 08, 1998.

BACKGROUND OF THE INVENTION

1. Field of the Invention

This invention relates in general to a device for connecting one object to another object, and, more specifically, to a device that can be readily adapted to connect footwear members to several types of common recreational or sporting apparatuses.

2. Description of the Related Art

There are many situations where it is desirable to have one object coupled to another object in a manner that allows the objects to attach, unconnect, and then reengage with each other. For example, there are many sporting activities where a connection like the one just described could be employed. The sports that would benefit most from the current invention are those that involve a participant's feet being linked to a separate sporting apparatus. With these types of activities, the user's feet are usually supported by some sort of footwear member, such as a shoe or boot that has been specially designed for the individual requirements of each sport. Examples of such activities include water and snow skiing, several types of skating, and snowboarding.

The present invention is particularly applicable to the sport of snowboarding as it relates to the sport of skateboarding. Snowboarding is very similar to skateboarding and a large number of people who snowboard also ride or have ridden skateboards. Many of the tricks or maneuvers found in the sport of snowboarding are directly based on tricks that are performed on skateboards. For those who ride skateboards there has always been a desire to execute the same type of maneuvers on their snowboards as on their skateboards, but not all of the tricks found in skateboarding have been able to cross over into snowboarding.

Although snowboarding and skateboarding are incredibly similar, there is one major difference between the two sports. The way that the participant's feet interact with each type of board in these two activities is completely different. On a skateboard the user's feet are not fixed to the board in an immovable manner. As a result of this, there is almost an unlimited amount of tricks available for a skateboarder to perform since the board is free to flip, spin, and or rotate in any direction relative to the rider. A skateboarder also has the option of removing either one or both of his feet from the board while riding to even further increase the variety of tricks he can execute. Because of the free connection of the rider's feet to the board, the amount of tricks or maneuvers that a skateboarder can perform is not limited by his equipment but only by his individual ability and imagination to invent new combinations.

In direct contrast to how a skateboard is ridden, a snowboarder has traditionally ridden with his feet fixed to the board in an immovable manner. The majority of snowboards are equipped with what are known in the art as conventional strap bindings. Although this type of binding can take on a multitude of forms with many different constructions they all share the same limiting characteristic. Strap bindings are designed to be solidly mounted to the snowboard deck and are not intended to separate from the board or permit the user's footwear members to release and then reattach while riding.

In addition to the conventional strap snowboard bindings, in recent years a variety of different step-in binding systems have been developed. These types of bindings are very similiar to the strap binding designs, but instead of straps some kind of mechanical operator is employed to secure the user's footwear into the bindings. Although in some areas of performance many of the step-in binding systems offer advantages over the strap binding designs, they still share the same limiting characteristic of their counterparts. Step-in snowboard bindings are also designed to affix the rider's footwear members to the board in a manner that is not intended to release and then reattach while one is riding.

In addition to the various strap and step-in binding systems that are widely in use, several forms of hybrid binding systems exist within the art. These systems aim to solve a variety of the different problems or drawbacks that are associated with all snowboard bindings in general. The hybrid bindings are most often concerned with issues like making the bindings easier and more convenient for the rider to use and actually do not function that much differently from the strap and step-in binding systems. There is also a category of snowboard bindings that have been designed to release from the board in some manner or another, but most of these systems are intended to operate like ski bindings with safety as their main consideration. There is yet to be a snowboard binding system designed to completely separate and then reattach to the board while one is riding in order to increase the number and type of tricks that can be performed.

With bindings that do not separate from the snowboard, it is possible to execute a limited amount of maneuvers where one removes his foot from the board. In order for these tricks to be performed, a rider has to either unstrap or disengage one of his bindings. The only option available for the rider is to unfasten his rear foot because at least one foot must stay attached to the snowboard in order for the rider to be able to steer the board and this is most easily accomplished with the front foot still attached.

With his front foot engaged with the front binding and his rear foot disengaged from the rear binding the rider can then proceed towards a jump or obstacle. He can hit the jump and perform a one-footed trick. The rider then has to land with his rear foot out of the rear binding and only resting on the snowboard deck. After landing the trick, the rider has to stop and replace his rear foot back into the rear binding before he can continue to ride like normal.

There are several drawbacks to this method of performing one-footed tricks. First of all, it is rather difficult to steer the snowboard with only one foot engaged in a binding. It is also somewhat dangerous to ride a snowboard when one foot is immovably fixed to the board and one foot is free. Also, the option of removing both feet while in the air to perform even more difficult tricks is not a possibility because of the fact that at least one foot has to remain attached to the snowboard in order for the rider to be able to control the snowboard.

With the bindings that are currently available for use with snowboards, the amount and types of tricks available for snowboarders to perform has been greatly limited. For riders looking to be able to execute more tricks with their snowboards there exists a need for a binding system that is designed to permit either one or both of the rider's feet to become completely separated and then reattach to the board while riding.

BRIEF SUMMARY OF THE INVENTION

The present invention is a device that can be employed to connect separate objects together in a manner that allows the individual objects to be coupled together, separate, and then reattach with each other. One area of application for the current invention is that it can be readily adapted to mount footwear members to a wide variety of recreational or sporting apparatuses, such as, for example skates, skateboards, snowboards, skis, etc. Even though the features of the current invention are described and illustrated herein in the specific context of snowboard bindings, it is not limited to snowboards because its features can be applied to a variety of recreational or sporting devices as well as to any two objects in general.

The footwear mounting system described herein has a refined, targeted design with several key advantages over the prior art. As directed to the sport of snowboarding, the present invention resolves the aforementioned problem with previous binding devices by making it possible for snowboarders to remove and then reattach either one or both of their footwear members from the board while riding. The invention accomplishes this by securing the footwear members used for snowboarding to the snowboard in every direction necessary to control the board except for one, so as to leave a method of release and subsequent reengagement. Allowing a snowboarder to completely separate either one or both of his feet from the board while riding is an improvement upon earlier devices from the aspect that it greatly increases the amount and type of tricks that the rider is able to perform.

Another solution of the present invention is to provide a binding system that releases in a natural manner while at the same time being somewhat easy to relocate into the locked riding position. The current invention operates with a method of release where the rider simply has to tilt either one or both of his feet forward or backwards in relation to the snowboard in order to separate one or both of his footwear members from the board. To reattach his footwear member or members into the locked riding position a rider just has to slide them back into place on the snowboard.

Yet another solution of the present invention is to supply a releasable and reattachable binding system that is safe for a rider to use by incorporating features which permit the user to select and or control when and if either one or both of his footwear members are able to separate from the snowboard. If a rider chooses to remove only one of his footwear members to perform a trick then these same features also provide a type of secondary safety release for the other member that is still attached to the snowboard.

A further solution of the invention is to have a releasable and reattachable binding system that will not clog with snow too easily. All of the parts are specifically shaped and designed to expel snow from their surfaces. The lateral engagement in combination with the relatively open method of mounting the binding to the snowboard all function to further eliminate or work around potential snow buildup within the system.

Additional features of the invention may include one or more of the following features.

The binding parts are specially shaped to help guide them into place with each other and thus facilitate a fluid engagement of the device.

Some of the binding pieces may have a plurality of holes or cutouts that function to remove snow from their surfaces.

A bottom surface of the footwear member is in direct contact with the top surface of the snowboard so that the forces necessary for controlling the board can be applied from the footwear.

The overlapping and interlocking connection between the two primary binding parts allows for multiple locations of attachment, including some where the separate members are not completely engaged, but still allow the rider to control or steer the snowboard.

Disclosed is a footwear mounting device that consists of two primary parts that are configured to release and reattach to each other.

A first angled bar is mounted to the snowboard deck and a second angled bar is incorporated with the footwear member.

A coupling unit is mounted upon the first angled bar and a corresponding coupling block is secured to the second angled bar. The coupling unit and the coupling block are designed to automatically engage with each other when the first and second angled bars are brought together in order to unite the two individual pieces.

The coupling unit includes a spring loaded latch that moves up and down in relation to the top surface of the snowboard in order to engage and disengage with the coupling block.

An additional unit to be known as the release enabler is mounted to the first angled bar in a position to interact with the coupling unit. With the release enabler a user is able to regulate the operation of the coupling unit. When the release enabler is in the open position the spring loaded latch can move to disengage with the coupling block and thus the angled bars can separate from each other. When the release enabler is in the closed position the spring loaded latch cannot move to disengage from the coupling block so the angled bars cannot separate from each other (unless they are exposed to a great deal of force whereupon the angled bars will separate as a matter of safety).

Advantages of the present invention include, but are not limited to the ability for snowboarders to release and then reattach either one or both of their footwear members from the board while riding. This is accomplished in a manner that is not only natural for the rider to execute, but also relatively easy for the rider to achieve because of the interlocking shapes of the individual binding parts, while at the same time being safe to use and considerably immune to snow buildup within the system.

BRIEF DESCRIPTION OF THE DRAWINGS

The present invention can be completely understood by reading the forthcoming detailed description in combination with the accompanying drawings, in which.

DETAILED DESCRIPTION OF THE INVENTION

Figure 1:
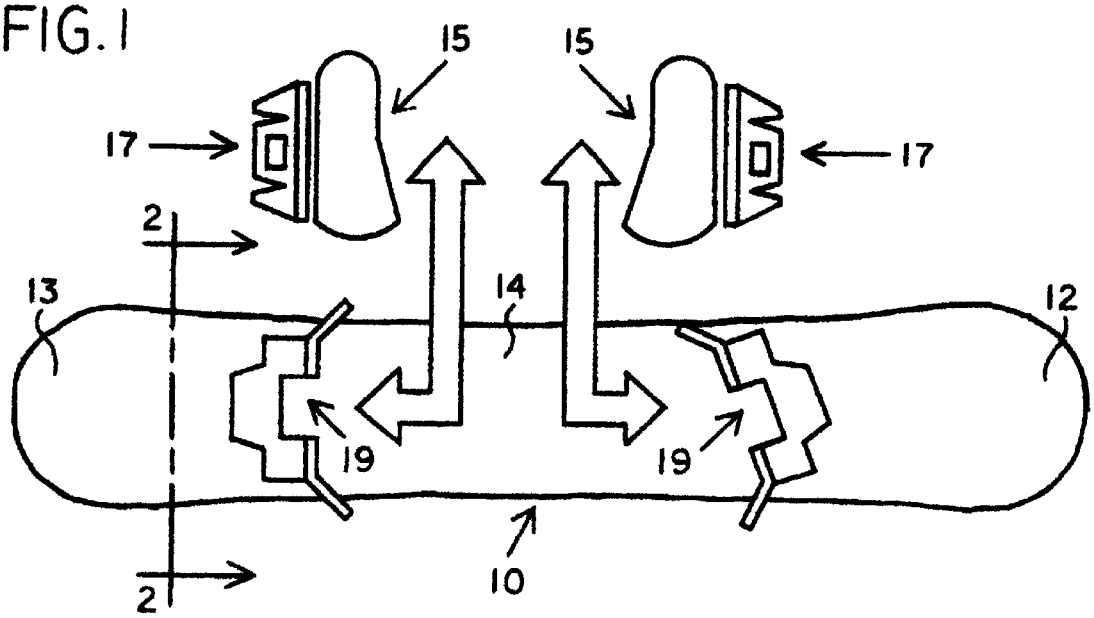
FIG. 1 is a plan view of a snowboard and footwear members equipped with the present invention.

FIG. 1 illustrates the general layout of a snowboard 10 and footwear members 15 that have been equipped with the current invention. In most cases a snowboard 10 and footwear members 15 will be outfitted with two sets of releasable and reattachable connecting devices so that one pair corresponds to each of the user's feet. Since both sets of connecting devices are identical and interchangeable, only one set will be described in detail in order to simplify the description (except in cases where a discussion of both sets at once is necessary for the understanding of the invention).

Each releasable and reattachable connecting device is comprised of two main parts, the footwear angle 17 and the board angle 19. In a preferred embodiment of the invention the overall shape of the board angle 19 is defined by a top face 80, a slanted area 85, and a bottom side 90. The top face 80 of the board angle 19 features pieces to be referred to as the edge clips 21. The edge clips 21 play an important role in the engagement between the board and footwear angle 19, 17. As viewed in the drawings, the edge clips 21 are separate members of the board angle 19 that are attached to the top face 80 of the board angle 19 by a set of t-nuts and flat headed screws 53. But this is not the only manner in which this particular component of the invention can be constructed. The edge clips 21 could be affixed with a high strength adhesive or they could be formed as an integral part of the body of the board angle 19.

The bottom side 90 of the board angle 19 features a device to be referred to as the coupling unit 30. The coupling unit 30 is responsible for securing the board angle 19 and the footwear angle 17 together. It is comprised of a u-shaped latch 25 that rotates about a pivot rod 37 while being acted upon by a torsion spring 26. The spring 26 is biased by a tension rod 38 and contact with the bottom side 90 of the board angle 19. This entire assembly is anchored into place by being inserted through the latch mounts 27. The latch mounts 27 are vertically extending fins that can be formed as part of the bottom side 90 of the board angle 19. Although this is the best mode for carrying out the coupling unit 30, other methods of construction could be called upon as well.

Another key component of the invention that is located in a position beside the coupling unit 30 on the bottom side 90 of the board angle 19 is the release enabler 20. The release enabler 20 is a somewhat complicated device that governs the movement of the coupling unit 30. One embodiment available for the release enabler 20 is most clearly viewed in FIG. 12. Here each release enabler 20 is shown to have a body 45 that houses a movable shaft 28 where the movable shaft 28 can rest in two alternate positions in relation to the body 45. The movable shaft 28 projects in length past the body 45 according to which alternate position that the movable shaft 28 rests in. The movable shaft 28 can be positioned over the coupling unit 30 (or u-shaped latch 25) in order to impede its movement or it can be positioned to allow the coupling unit 30 (or u-shaped latch 25) to move freely, To facilitate engagement and disengagement with the coupling unit 30, the movable shaft 28 features a tapered tip 82, Another feature of the movable shaft 28 is its oversized handle 75 that a user can easily grasp while wearing gloves in order to change its position, As with the other elements of the current invention there are obviously many additional ways of constructing the release enabler 20 and or any of its individual parts that could work as well as those just stated.

Located underneath the board angle 19 and performing several important functions are pieces to be referred to as the riser pads 33, The riser pads 33 elevate the board angle 19 above the top surface of the snowboard 10 so that the footwear angle 17 will be able to slide underneath, The riser pads 33 also provide support for the board angle 19. The ribbed segments 41 of the riser pads 33 keep the board angle 19 from being bent or smashed down from above. The riser pads 33 should be somewhat triangular in shape and contain a hole or plurality of holes to be involved with the mounting of the board angle 19 to the snowboard 10.

Each board angle 19 should be mounted somewhere on the riding surface 14 of the snowboard 10 according to each rider's individual preference, There are a variety of different positions available for a rider to choose from. In FIG. 1 a "left foot forward" (or regular footed) formation of the footwear members 15 is depicted, This layout can also be reversed to a "right foot forward" (or goofy footed) arrangement (not pictured). In addition, the relative angles that the board angles 19 are mounted to the snowboard 10 can be adjusted.

The best mode for mounting each board angle 19 (and riser pads 33) to the snowboard 10 is with screws 52, This technique is well known throughout the art as most snowboards that are produced include a plurality of threaded inserts that can receive the screws used for mounting the bindings. The board angle 19 and riser pads 33 could also be attached to the snowboard 10 with an appropriate adhesive or both of these parts could be formed along with the top sheet of the snowboard 10.

Corresponding to the shape of the board angle 19, the overall shape of the footwear angle 17 is defined by a top face 60 and a bottom side 70. The bottom side 70 of the footwear angle 17 features a piece to be known as the coupling block 23. The coupling block 23 is somewhat triangular in shape and is mounted in a position to be able to engage with the coupling unit 30. The coupling block 23 can be held in place by screws 50 or it could be set in place by a suitable adhesive or formed as part of the body of the footwear angle 17.

Figure 3:
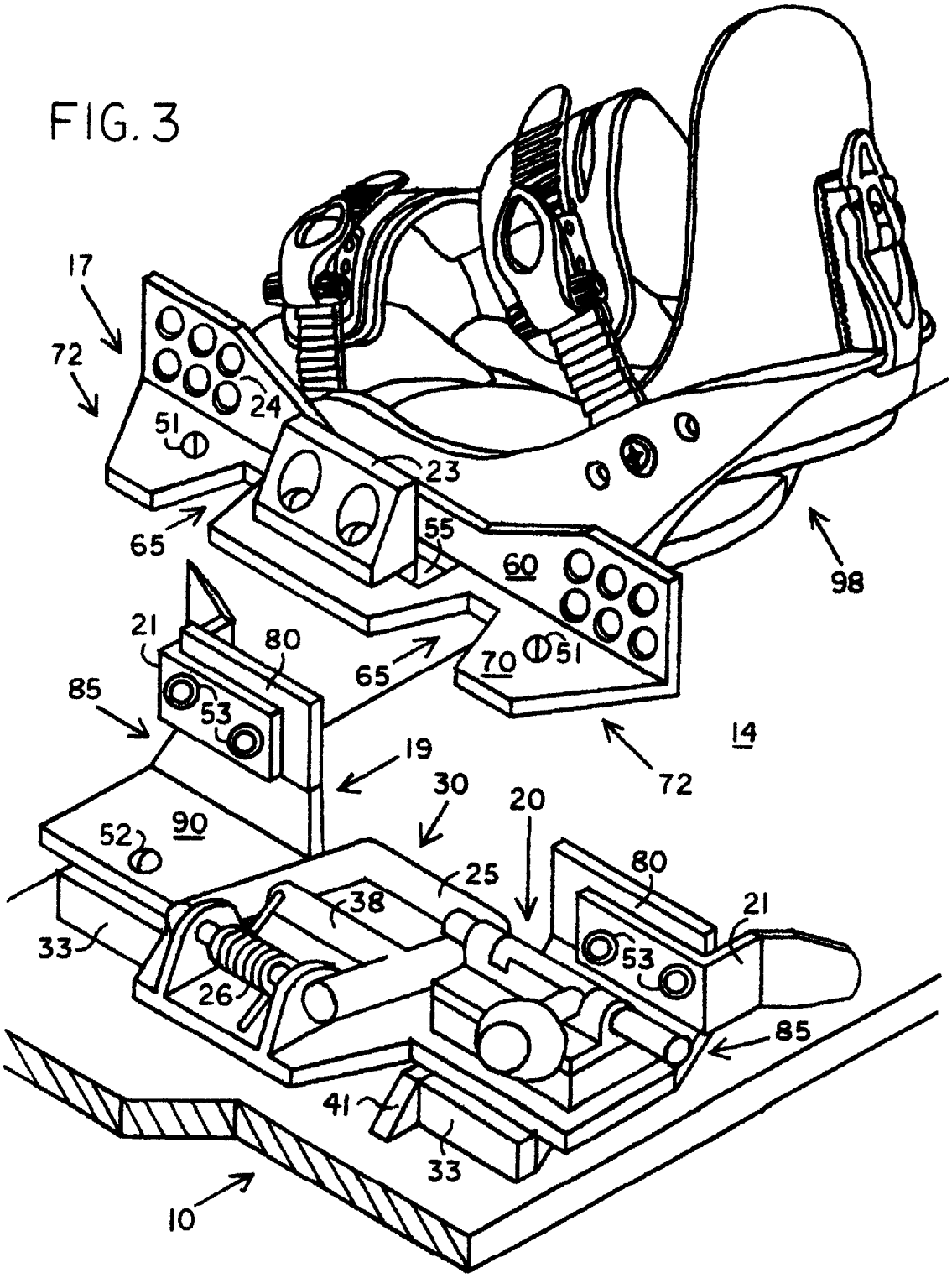
FIG. 3 is an isometric exploded view of a snowboard and a conventional strap binding outfitted with the elements that comprise the releasable and reattachable connecting device.
Figure 4:
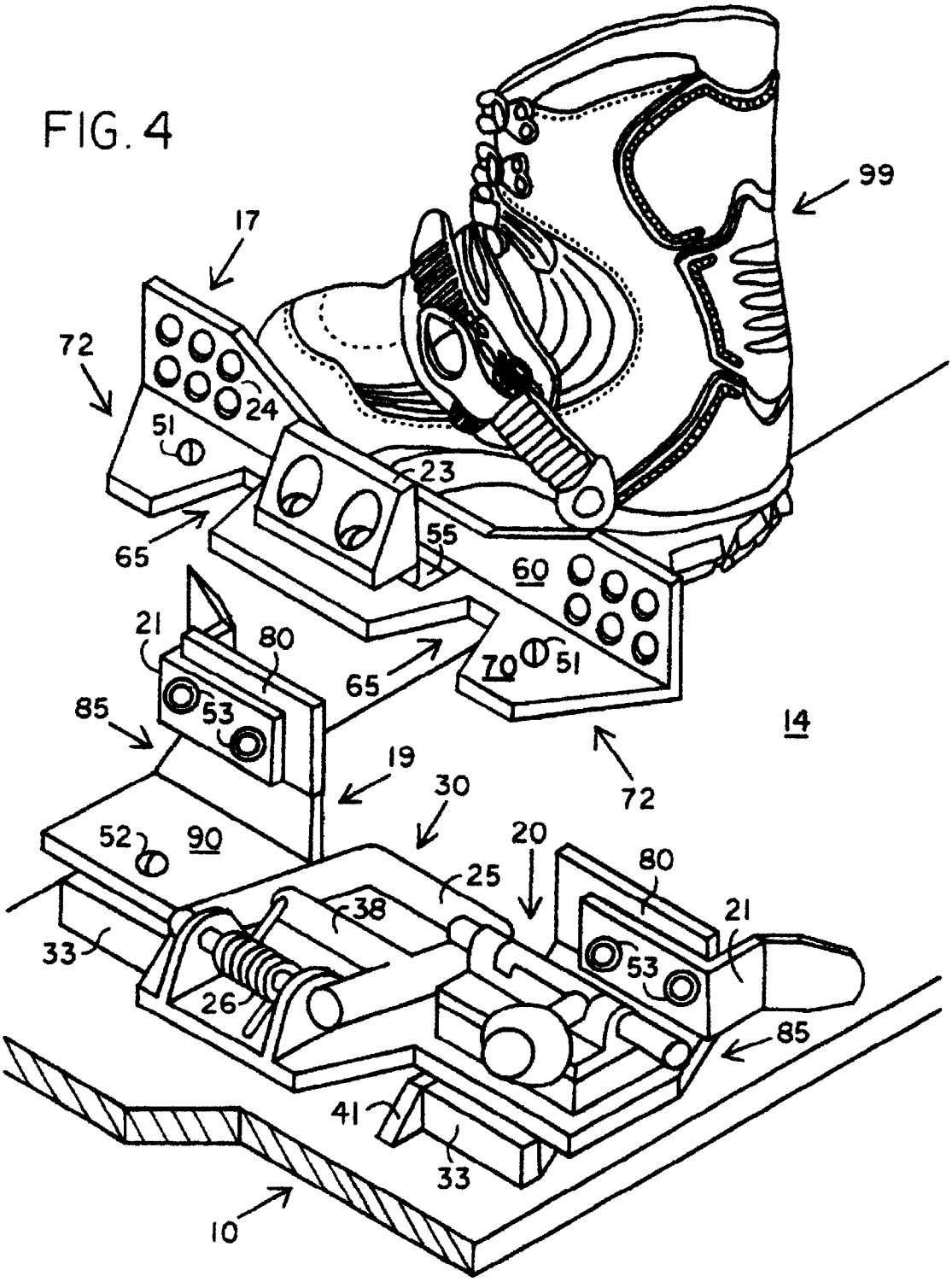
FIG. 4 is the same isometric exploded view as FIG. 3, but this time it demonstrates another embodiment of the invention where a snowboard and a tpe of snowboarding boot have been equipped with the present invention.
Figure 5:
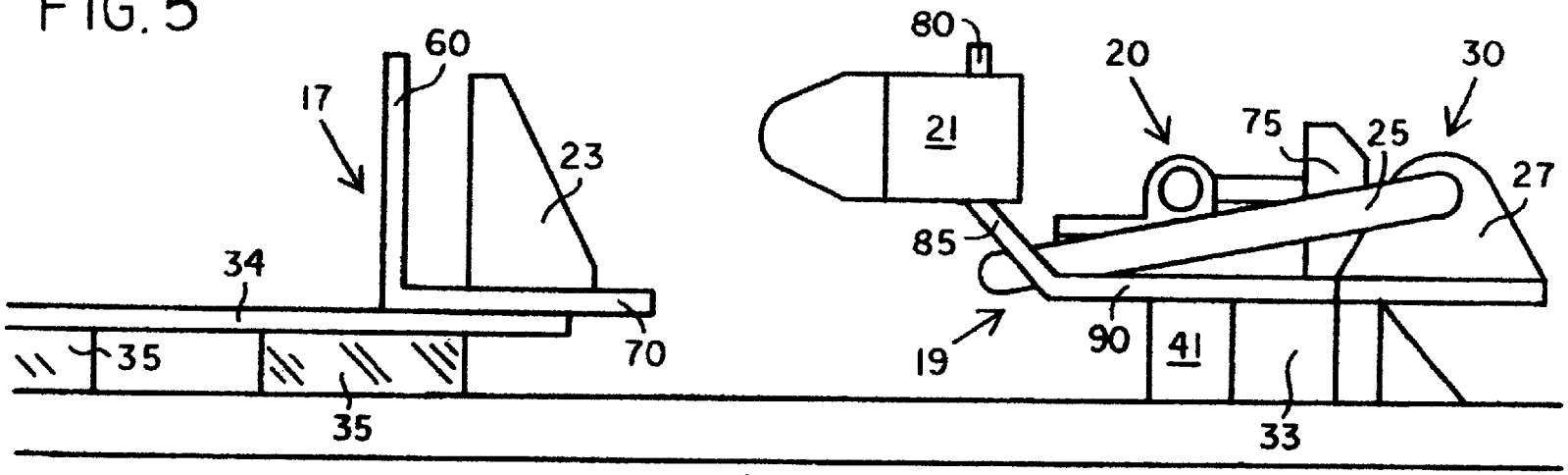
FIG. 5 is an elevation view (without showing the strap binding or boot for clarity) that illustrates the position of the two separate pieces of the connecting device before engagement.
Figure 6:
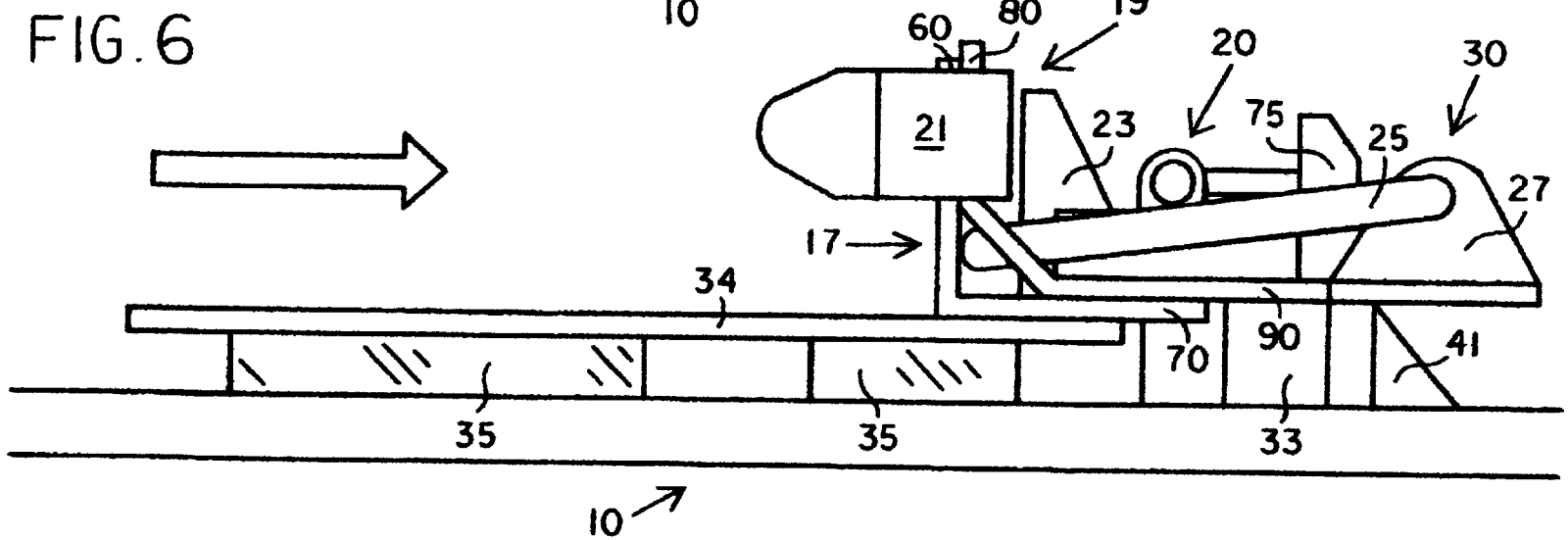
FIG. 6 is the same elevation view as in FIG. 5, but this time it shows the two main parts of the invention coupled together.

As seen in several of the drawings, the body of the footwear angle 17 can be mounted to bar-like structures 34 with screws 51. These bar-like structures 34 can then be used as a means for attaching the footwear angle 17 to an appropriate type of snowboarding footwear member. The bar-like structures 34 can include pads 35 that serve several functions. One purpose of the pads 35 is to raise the footwear angle 17 to the proper height above the top surface of the snowboard 10 so that it fits tightly below the board angle 19 (as best seen in FIG. 6). Another job of the pads 35 is to supply some amount of shock absorption for the binding system. The pads 35 should be formed out of a hard or soft rubber (or a similar kind of material) and can be glued into place on the bar-like structures 34 with a suitable adhesive or secured by a variety of different methods. In addition to the above configuration, other embodiments of the footwear angle 17 are possible. For example, it could just be formed as part of the strap binding 98 (as seen in FIG. 3) or a special footwear member 99 could be constructed having the body of the footwear angle 17 protruding from one side of its sole (as seen in FIG. 4).

The bodies of both the footwear angle 17 and the board angle 19 must be able to withstand the stresses that they will encounter as they are being employed as bindings for a snowboard 10. In this role they will also be required to operate under a wide variety of temperature and weather conditions. Both of these pieces 17 and 19 should be constructed from a material or combination of materials that are lightweight, strong, and resist adhesion to snow and ice particles. Examples of suitable materials would include high strength aluminum, carbon fiber, a synthetic thermoplastic resin (such as polyethylene, nylon, Delrin, Teflon, etc.), or any other suitable material that possesses the desired qualities. The present invention may be cast or molded, as with an injection process, from such materials in no more than a few pieces and then assembled into the final form.

Now that the main parts of the releasable and reattachable connecting device have been identified it is time to describe how they function when utilized as snowboard bindings that can release and reattach to the board.

In order to steer or turn (also known as carving) on a snowboard 10, the positioning of a rider's footwear members 15 on the board must be fixed (they cannot move around completely free like on a skateboard). To carve turns on a snowboard 10 a rider either raises his toes and leans back on his heels to go in one direction (also known as a frontside turn) or he raises his heels and pushes down on his toes to go in the opposite direction (also known as a backside turn). Thus, a snowboard binding system must at a minimum completely anchor the rider's heels and toes to the board.

On the present invention this is accomplished through the overlapping connection of the board angles 19 with the footwear angles 17. This is best viewed in FIG. 6 where it can be seen how the bottom side 90 of the board angle 19 covers the bottom side 70 of the footwear angle 17 when the two parts are engaged with each other. This configuration secures the rider's toes and heels to the snowboard 10 in a manner that enables him to bring the board up on either edge to steer the board.

In addition to the above requirement for steering a snowboard 10, to keep a board under control, a rider's footwear members 15 cannot move side to side in relation to the left edge 11 or right edge 16 of the snowboard 10. The present invention meets this need with the edge clips 21 that are located on the top faces 80 of each of the board angles 19. They work in unison with the aforementioned overlapping connection between the board angles 19 and the footwear angles 17 to keep the rider's footwear members 15 fixed in their position on the snowboard 10.

And finally, a snowboard binding system cannot permit a rider's footwear members 15 to move forward towards the front (or nose) 12 of the snowboard 10 or backward towards the rear end (or tail) 13. The abutment of the top faces 60 of the footwear angles 17 with the corresponding top faces 80 of the board angles 19 and the respective connections between the coupling units 30 and the coupling blocks 23 prevent the user's footwear members 15 from moving forward or backward in relation to the snowboard 10. When the footwear angles 17 and board angles 19 are united by the complementary shapes of their individual parts an adequately fixed connection is achieved. This connection allows a rider to turn or carve the snowboard 10 in the same manner as one that is equipped with a conventional binding system.

With the conditions necessary for steering the snowboard 10 met by the current invention a method for releasing the rider's footwear members 15 from the board is now required. The main concept behind this invention is to introduce a device that secures a rider's footwear members 15 in every manner necessary to control the board except for one. The direction that is omitted then becomes the method by which the invention can allow the footwear members 15 to completely release from the snowboard 10.

Figure 2:
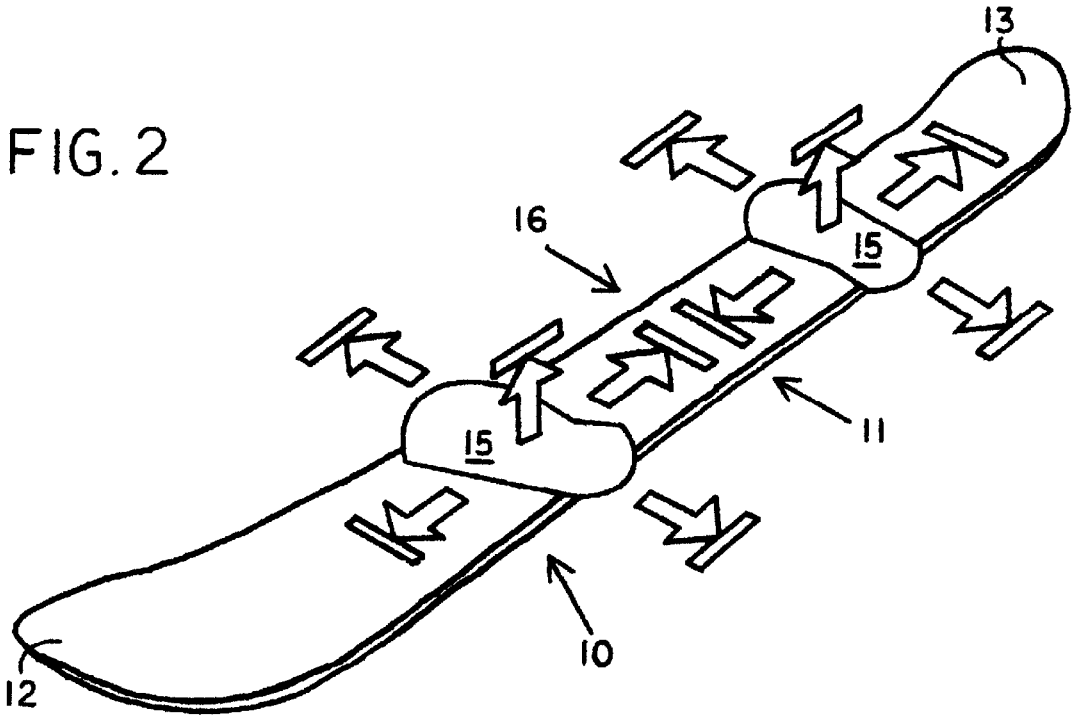
FIG. 2 is an isometric view that illustrates the directions that the current invention secures a user's footwear members in relation to the snowboard.

The arrows in FIG. 2 illustrate the directions that the current invention secures the rider's footwear members 15 in relation to the snowboard 10. It can be seen how the releasable and reattachable connecting device does not allow the rider's footwear members 15 to move forward towards the front (or nose) 12 of the snowboard 10, backward towards the rear end (or tail) 13, sideways towards the left edge 11, sideways towards the right edge 16, or up in a direction perpendicular to the top surface of the snowboard 10. These restrictions leave only one direction for the device to move in order to release.

Figure 7:
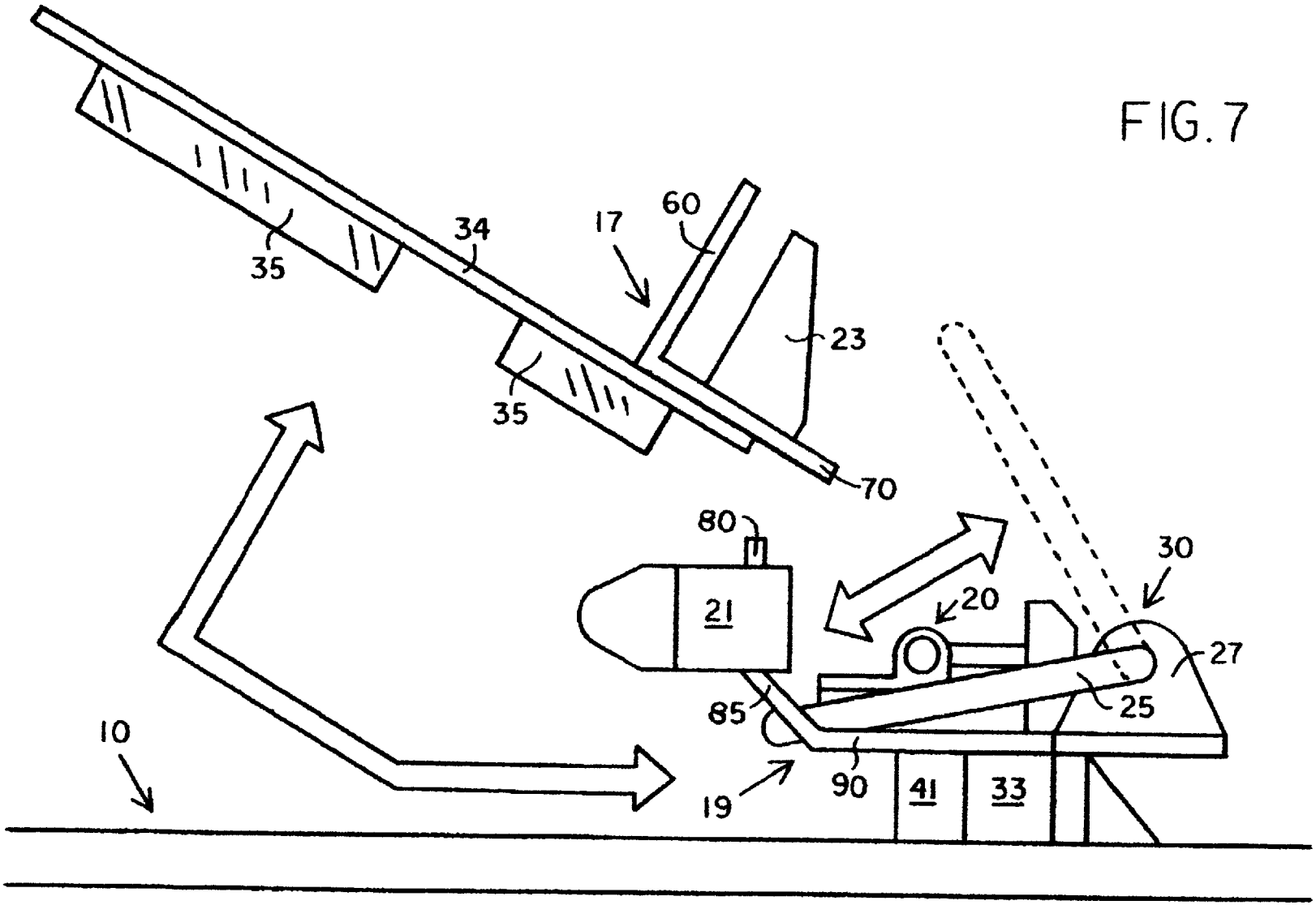
FIG. 7 is once again the same elevation view that is seen in FIG. 5, but now it displays the connecting device's path of disengagement and subsequent re-engagement.

The releasable and reattachable connecting device will only separate when it is tilted, as displayed by the arrows in FIG. 7. When a footwear angle 17 is tilted it causes the coupling unit 30 (or u-shaped latch 25) to release from the coupling block 23. This, in turn, allows the footwear angle 17 to disengage from the board angle 19. When the footwear angles 17 are attached to the outsides of the footwear members 15 as seen in FIG. 1, the front footwear angle 17 will have to tilt in a direction towards the front (or nose) 12 of the snowboard 10 and the rear footwear angle 17 will have to tilt in a direction towards the rear end (or tail) 13 of the snowboard 10. This is how a rider is able to remove one or both of his footwear members 15 from the snowboard 10 while it is in motion (some other conditions, discussed later under the safety concerns must be met before release can actually occur).

Because the releasable and reattachable connecting device is comprised of two main members that can separate from each other, the next major design concern is to make reuniting the pieces back together (relocating the footwear members 15 back onto the snowboard 10, sometimes while jumping through the air) as fluid and automatic as possible.

Several aspects of this invention function simultaneously to guide the footwear angles 17 back into place with the board angles 19. First of all, as illustrated in several of the drawings, the lateral engagement of this binding system facilitates realignment because a rider can place his footwear member or members 15 onto the riding surface 14 of the snowboard 10 and then slide them into the locked riding position. Next, the slanted areas 85 of the board angles 19 play an important role in reuniting the two separate pieces of the device. These areas 85 provide a crucial amount of clearance for the footwear angles 17 to return to their position underneath the board angles 19. Because of the slanted areas 85 a rider can also elect to bring the footwear angles 17 back into position on the snowboard 10 with the same angled movement as when they were released.

Figure 10:
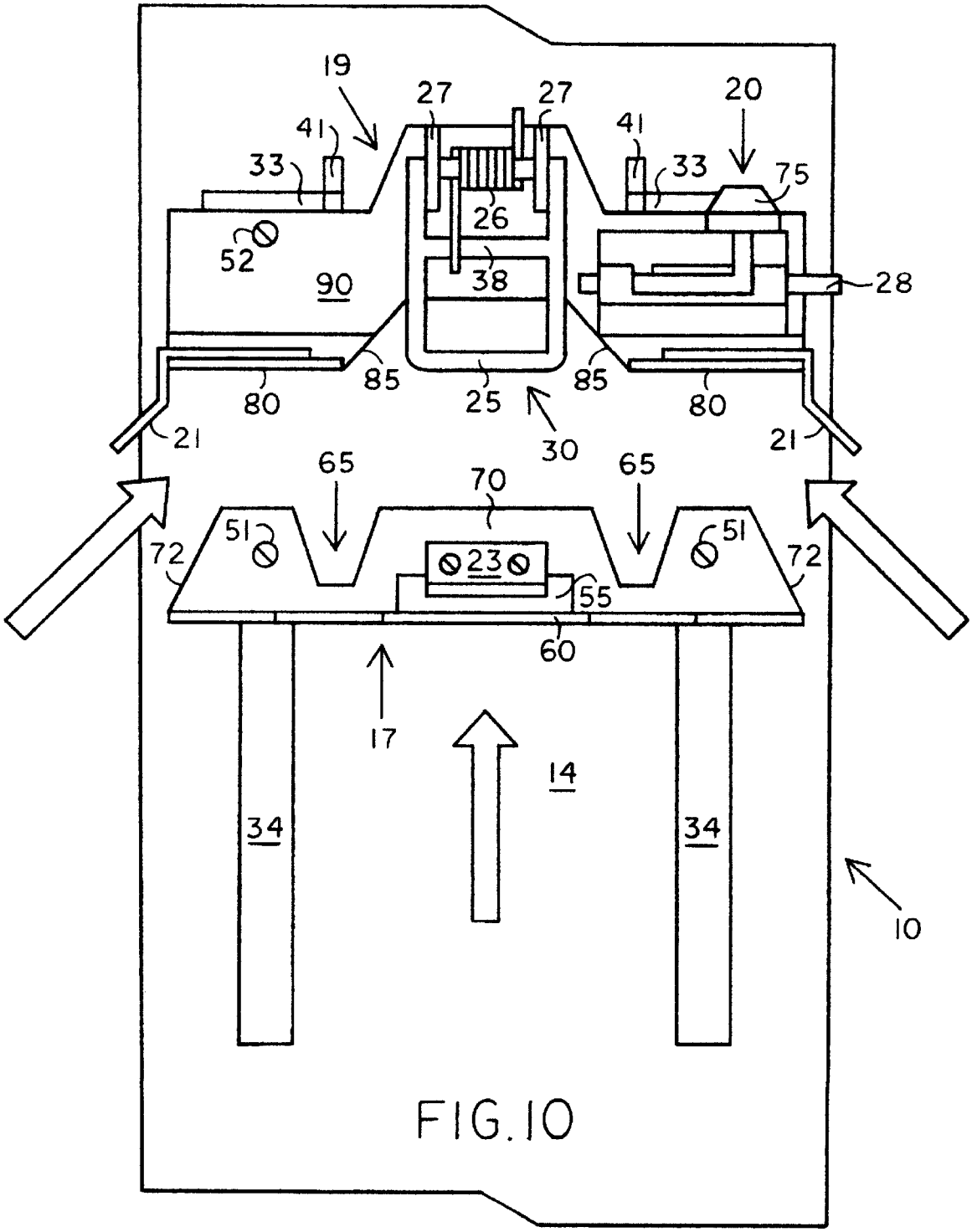
FIG. 10 is a plan view that demonstrates how the shapes of the different members of the invention function to guide themselves into engagement with each other.
Figure 11:
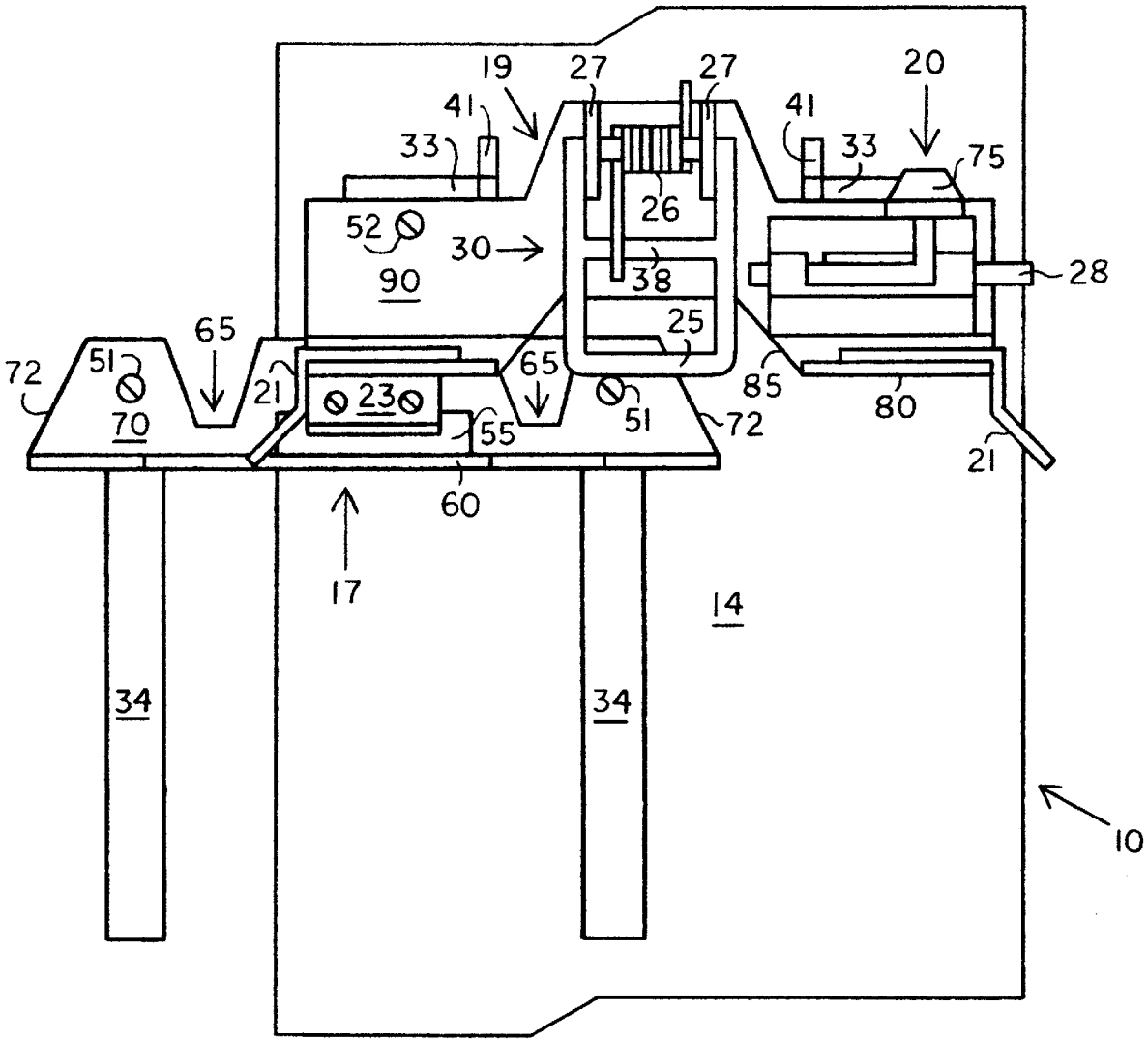
FIG. 11 is a plan view that depicts one of the alternate engagement positions available for the connecting device.

In addition to these features, the shape of the edge clips 21 helps to direct the footwear angle 17 back into the correct locking position with the board angle 19 (as best illustrated by the arrows in FIG. 10). Also, the slanted comers 72 of the footwear angle 17 help to guide it into position with the board angle 19. At the same time the angled cut-outs 65 of the footwear angle 17 fit around the ribbed segments 41 of the riser pads 33 so that the footwear angle 17 can slide underneath the board angle 19. Another important aspect of the current invention is that a rider's foot placement upon returning to the board does not have to be exact. As seen in FIG. 11, a rider can get his footwear member or members 15 close to where they need to go and still have control of the snowboard 10 until the device returns to a completely locked, ridable position. All of these details combine to provide a fluid and somewhat automatic method of re-engagement for the separate pieces of the releasable and reattachable connecting device either while the rider is on the ground or flying through the air.

Safety is a major concern with any snowboard binding and it is particularly crucial in the case of the present invention since it permits either one or both of the user's footwear members 15 to completely separate from and then return to the snowboard 10 while riding. Conventional strap snowboard bindings as well as their step-in binding counterparts are not designed to release from the board while riding and few injuries result from falls and crash landings. But it is an altogether different situation when it comes to a binding that can release from the board while riding. Very dangerous conditions can arise when one footwear member 15 is released and one footwear member 15 is still fixed to the snowboard 10. If a rider fell in that situation, he could become quite injured because the board could twist with a great deal of force and cause serious injury to his feet, ankles, and or legs.

The tilted method of release that allows the footwear angle 17 to separate from the board angle 19 has one major drawback that has to be overcome while at the same time keeping the system safe to use. This device if left as discussed so far will release rather easily while one is riding it. When tilting one footwear member 15, it is very difficult not to tilt the other one and cause both to release at the same time. So if a rider only wants to disengage one footwear member 15 to perform tricks like those illustrated in FIGS. 12 and 13 the opposite binding must be kept from releasing unintentionally while still being allowed to release in the event of a crash landing.

Figure 8:
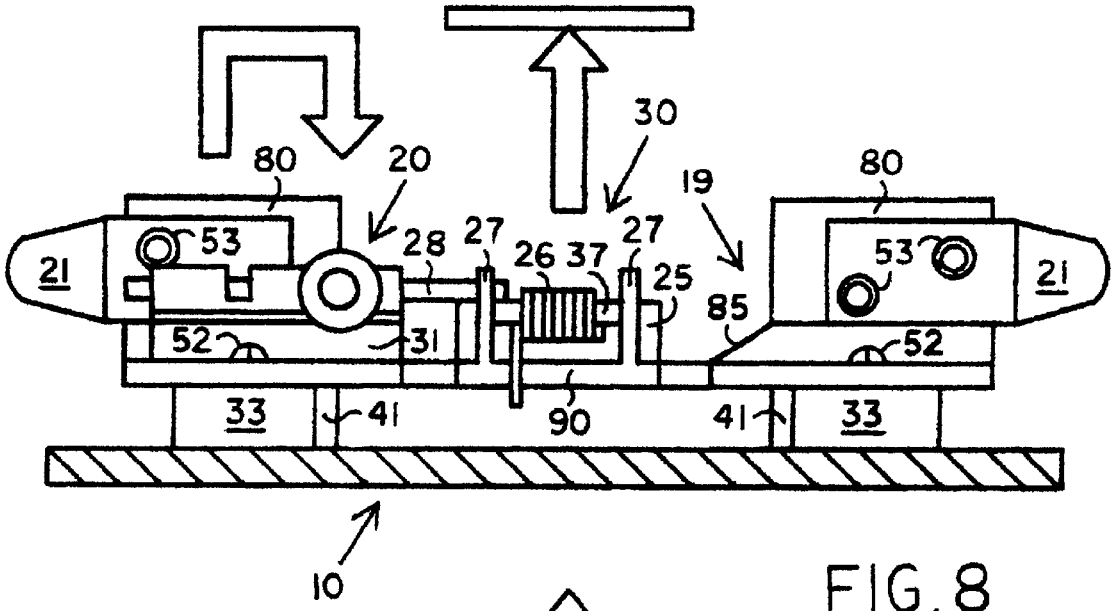
FIG. 8 is a transverse sectional view taken along line 2—2 of FIG. 1 that shows how the release enabler, when in the closed position, prevents the coupling unit from rotating upwards and thus does not allow the connecting device to separate.
Figure 9:
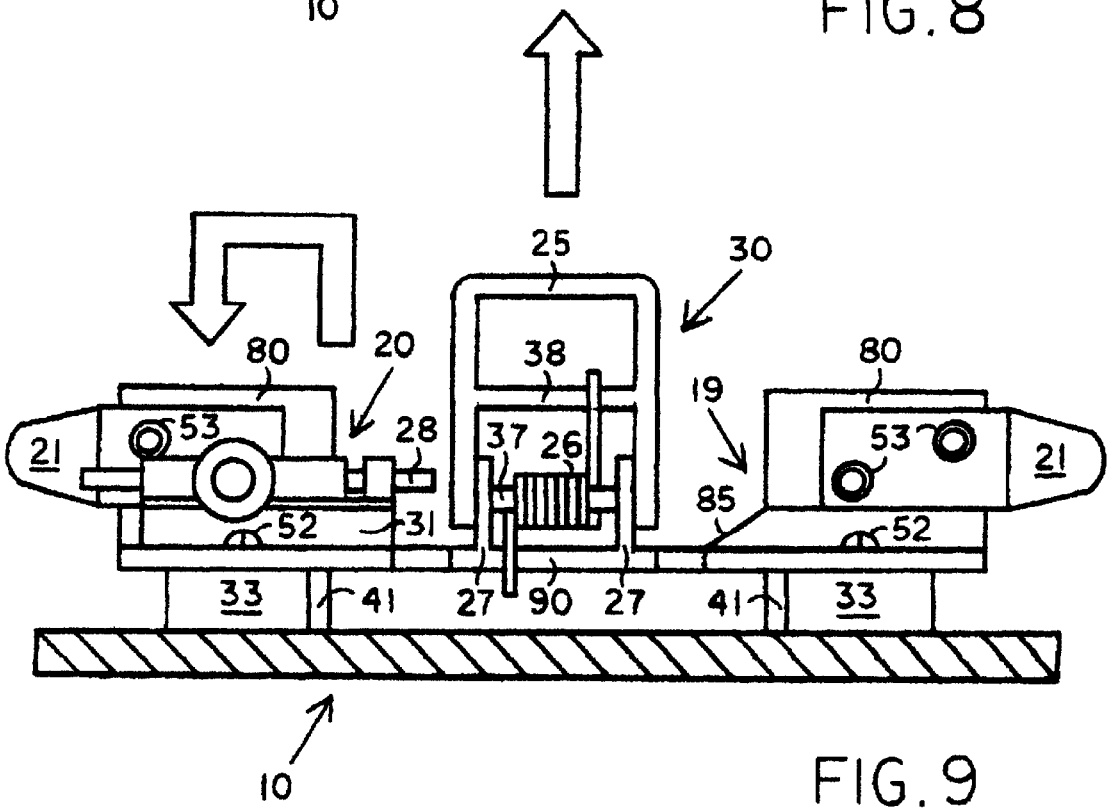
FIG. 9 is the same view of the device as shown in FIG. 8, but this time it illustrates how the release enabler, when in the open position, allows the coupling unit to rotate upwards which permits the binding to separate.

The coupling unit 30 is the part of the invention that is most directly responsible for the engagement or separation of the footwear angle 17 from the board angle 19. Thus, the movement of the coupling unit 30 must be closely regulated and this is the job of the release enabler 20. With the release enabler 20, the user has the option of selecting from an "open" or "closed" position for either one or both of his footwear members 15. In FIG. 9, it can be seen how the "open" position of the release enabler 20 (where the movable shaft 28 does not cross the u-shaped latch 25) permits the coupling unit 30 to move freely. This allows the footwear angle 17 to willingly engage or disengage from the board angle 19. In FIG. 8, it can be seen how the "closed" position of the release enabler 20 (where the movable shaft 28 does cross over the u-shaped latch 25) restricts movement of the coupling unit 30. This results in a more powerful attachment of the footwear angle 17 to the board angle 19.

Although the release enabler 20 is capable of more strongly securing the footwear angle 17 to the board angle 19, it will still allow the footwear angle 17 to release upon being exposed to a predetermined amount of force. This feature is best described as being a form of safety release for the binding system and it relies upon a property that all snowboards share.

Snowboards are designed to flex in several directions while one is riding them and this characteristic can be taken advantage of to provide a method of safety release for the current device. Safety release means that even when a footwear angle 17 is secured underneath a board angle 19 by the engagement of the coupling unit 30 with the coupling block 23 in combination with the release enabler 20 being in the closed position, the footwear angle 17 can still be made to release when exposed to predetermined amounts of force (or board flex). In other words, if a rider crashes after only setting one footwear member 15 to release from the board, the other footwear member 15 that was still fixed to the snowboard 10 will also release upon being exposed to the forces (or board flex) that it will undergo during the crash landing.

Figure 12:
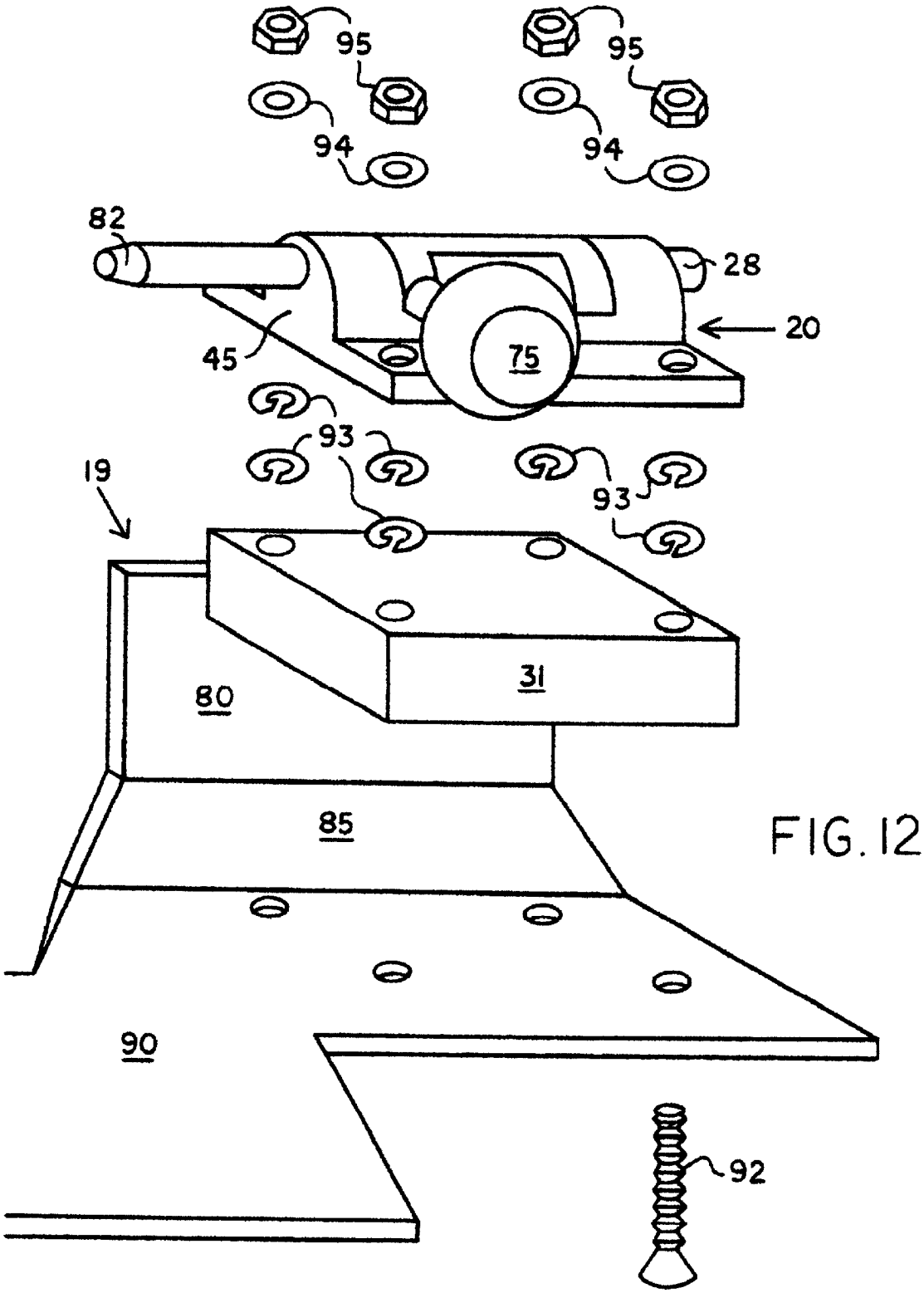
FIG. 12 is an exploded isometric view that details one method of constructing the release enabler.

Several parts of the connecting device can be attuned to work in conjunction with the natural flex patterns of the snowboard 10 in order to adjust and regulate the operation of the safety release. To begin with, the release enabler 20 should not be immovably fixed to the board angle 19. It should be connected in a manner that allows a user to adjust how tightly it is mounted. One method of attachment that meets this requirement is illustrated in FIG. 12. Here the release enabler 20 is secured to the bottom side 90 of the board angle 19 on a mounting pad 31 and held in place with a group of screws 92 and nuts 95. A plurality of lock washers 93 should also be included so that the strength of the connection can be adjusted according to each rider's individual requirements. Besides this particular construction there are obviously many other ways to anchor the release enabler 20 while at the same time allowing it to slightly move upon being exposed to a predetermined amount of force (such as the use of a plurality of compression springs instead of the lock washers 93).

In addition to having a "floating" release enabler 20, the relative tightness of the mounting screws 52 can be adjusted to control how far the board angle 19 has to flex in conjunction with the snowboard 10 before resulting in safety release. Also, the height of the coupling block 23 can be varied as yet another method of determining how much board or binding flex is required before safety release can occur. A taller coupling block 23 means that a greater amount of force will be needed to activate safety release while a shorter coupling block 23 results in less force being required to achieve safety release. All of these features can be adjusted individually or as a group until a rider discovers a safety release setting that works best for his particular ability and riding style.

The last objective to be met by the present invention when it is adapted for use with snowboards is that it should be designed to not clog with snow too easily and or still be able to operate with some snow buildup within the system. No snowboard binding is always going to completely keep snow from lodging within its parts, but steps can be taken to reduce the amount that does. Areas that must not become clogged with snow include all of the contact points between the board angles 19 and the footwear angles 17. If snow and ice particles accumulate on these pieces they will not be able to freely engage and disengage with each other. The plurality of holes 24 that are located on the top faces 60 of the footwear angles 17 combat snow buildup in this area. For the bottom sides 70, 90 of the footwear and board angles 17, 19 the space provided by the slanted areas 85 of the board angles 19 allows for a small amount of snow buildup within the system while still permitting the binding to operate (as best seen in FIG. 6).

Another realm that should be kept clear of snow is the area located underneath the board angles 19 in the space between them and the top surface of the snowboard 10. The open design of how the board angles 19 are mounted to the snowboard 10 in combination with the lateral engagement of the footwear angles 17 with the board angles 19 helps to push snow out from under the bindings. Also, the area where the coupling units 30 enclose the coupling blocks 23 must be kept clear of snow in order for the device to operate properly. To meet this requirement the segments of the bottom sides 70 of the footwear angles 17 that the u-shaped latches 25 rest upon when engaged with the coupling blocks 23 have been cut out 55. To even further reduce the buildup of snow and ice particles from within the releasable and reattachable connecting device, other embodiments could be constructed that have larger openings in certain areas and or contain additional holes or cutouts in places where snow tends to accumulate.

By adapting the features of the releasable and reattachable connecting device for use in the sport of snowboarding a larger number of tricks from skateboarding will now be able to cross over into the sport of snowboarding.

Figure 13:
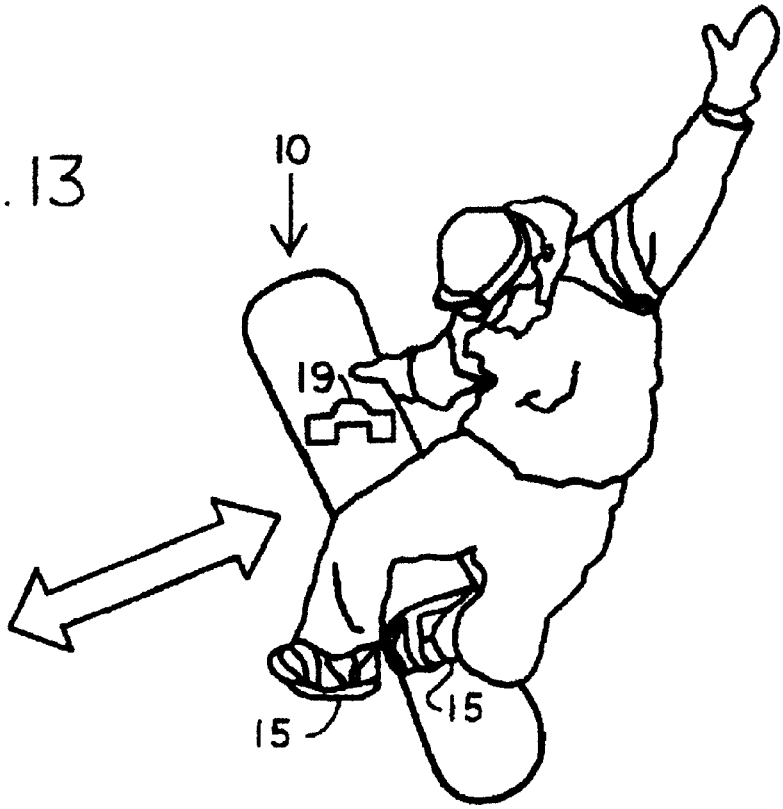
FIG. 13 demonstrates how a rider can remove and replace his front footwear member from the snowboard in order to perform a trick according to the present invention.
Figure 14:
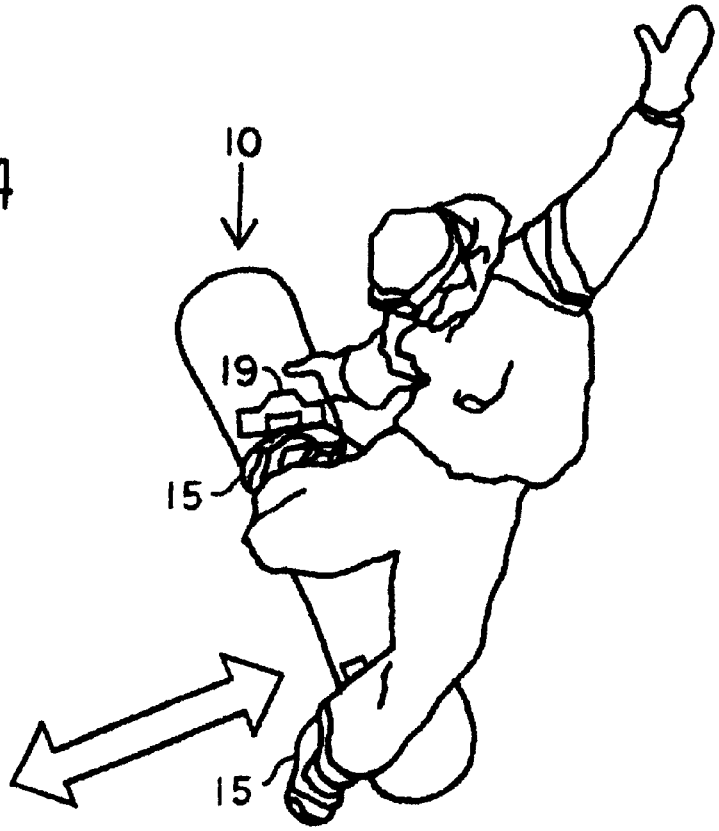
FIG. 14 shows how a rider can remove and replace his rear footwear member from the snowboard in order to perform another kind of trick.

FIG. 13 demonstrates how a rider can remove and replace his front footwear member 15 from the snowboard 10 in order to perform a trick (which is known as a judo air). FIG. 14 shows how a rider can remove and replace his rear footwear member 15 from the snowboard 10 in order to perform another kind of trick. To execute these types of one-footed maneuvers a rider has to follow certain steps. First of all, he has to decide which footwear member 15 that he wants to remove and then return to the snowboard 10. If a rider wants to release his front footwear member 15 to do a trick, then he has to place the front release enabler 20 in the open position. If a rider wants to release his rear footwear member 15 to do a trick, then he has to place the rear release enabler 20 in the open position. He can then ride over the jump or obstacle, tilt and remove whichever footwear member 15 he has chosen to release, style out the trick, replace his free footwear member 15 back into the binding, land and ride away (reaching down to slide the release enabler 20 back into the closed position if he does not want to release his foot anymore).

Figure 15:
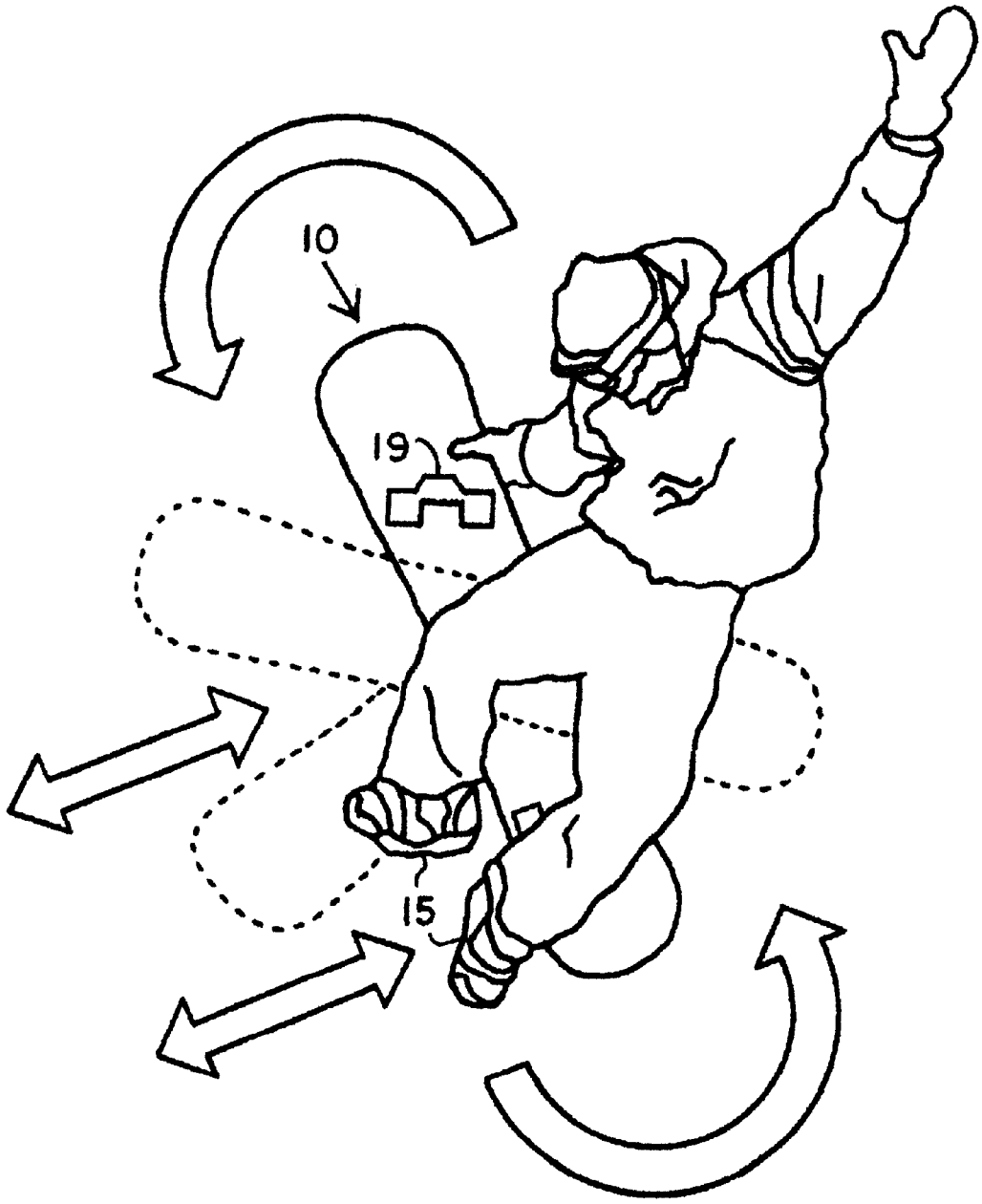
FIG. 15 illustrates how a rider can remove and replace both of his footwear members from the snowboard and or also rotate the snowboard in any direction relative to himself in order to perform even more types of tricks.

Even more complicated tricks can be performed on snowboards according to the present invention. FIG. 15 illustrates how a rider can choose to remove and replace both of his footwear members 15 from the snowboard 10 and or rotate the board in relation to himself in order to perform very difficult maneuvers. To execute these types of stunts the rider has to place both release enablers 20 (front and rear) in the open position. He can then travel over some type of obstacle or jump, tilt both of his footwear members 15 in the respective directions required to release them, (rotate the board in relation to himself), return his footwear members 15 into position on the board, land and ride away (once again reaching down to place the release enablers 20 in the closed position if he does not want to remove his feet again).

Note: When executing any of the above maneuvers it is important for the rider to grab the snowboard 10 earlier than normal and also hold onto it longer than normal in order to have a better chance of completing the trick.

These are only some examples of the types of tricks that can now be performed on snowboards outfitted with the present invention. With this device there is virtually no limit to the variety and amount of tricks that can be executed on snowboards. The only restriction on the progression of the sport of snowboarding will be the imagination and skill of the individual riders involved.

The preceding description should be more than adequate to allow someone skilled in the art of snowboards and snowboard bindings to adapt and use the features of the releasable and reattachable connecting device for the sport of snowboarding. After disclosing the principles of the invention with drawings and in writing with reference to multiple preferred embodiments, it is obvious that additional modifications and adaptations will arise to those skilled in the art. Nevertheless, it is to be explicitly understood that such modifications and adaptations are all within the range of the present invention. Thus the scope of this invention should be decided by the accompanying claims and their legal equivalents.

What I claim as my invention is:

1. A releasable and reattachable snowboard binding system comprising:

a snowboard, a footwear member, a first member of attachment connectable to the snowboard, and a second member of attachment connectable to the footwear member; each of said members of attachment being specifically shaped to overlap and interconnect with each other;

a coupling mechanism located on said first member of attachment, and a corresponding coupling block installed on said second member of attachment, said coupling mechanism and said coupling block being configured to automatically engage with each other thereby releasably securing the two members of attachment together, wherein said second member of attachment is disposed to completely release and then be reconnectable with the first member of attachment in response to movements applied by the snowboard rider; and a release enabler governing the action of the coupling mechanism, said release enabler further comprising a body that houses a sliding cylindrical shaft, the shaft configured to rest in at least two different positions including one position where the shaft overlaps a latch means of said coupling mechanism and an alternate position where the shaft does not overlap or in any way cover the latch means; said release enabler capable of supplying a retaining force to said coupling mechanism in order to more powerfully secure the second member of attachment to the first member of attachment in response to a selection made by the snowboard rider; said release enabler being additionally configurable to provide a backup safety release for the binding system according to additional settings and adjustments to the enabler provided by the snowboard rider.

* * * * *